US008033133B2

(12) United States Patent
Flores et al.

(10) Patent No.: US 8,033,133 B2
(45) Date of Patent: Oct. 11, 2011

(54) ICE BIN STORAGE WINDOW

(75) Inventors: Laura E. Flores, Nuevo Leon (MX); Michael A. Heaven, Coralville, IA (US); Bruce A. Kopf, Cedar Rapids, IA (US); Joseph M. Nurre, Marion, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 318 days.

(21) Appl. No.: 12/277,662

(22) Filed: Nov. 25, 2008

(65) Prior Publication Data

US 2010/0126202 A1 May 27, 2010

(51) Int. Cl.
*F25C 5/18* (2006.01)

(52) U.S. Cl. ..... 62/344; 62/441

(58) Field of Classification Search ..... 62/344, 62/441, 449, 459

See application file for complete search history.

(56) References Cited

U.S. PATENT DOCUMENTS

| | | | | |
|---|---|---|---|---|
| 4,127,765 | A * | 11/1978 | Heaney | 219/218 |
| 5,375,432 | A * | 12/1994 | Cur | 62/320 |
| 6,148,624 | A | 11/2000 | Bishop et al. | |
| 7,197,888 | B2 | 4/2007 | LeClear et al. | |
| 7,743,623 | B2 * | 6/2010 | Guarino et al. | 62/344 |
| 7,832,227 | B2 * | 11/2010 | Wu et al. | 62/344 |
| 2009/0255279 | A1 | 10/2009 | Kim et al. | |
| 2009/0255280 | A1 | 10/2009 | Kim et al. | |
| 2009/0255283 | A1 | 10/2009 | Kim et al. | |
| 2009/0272130 | A1 | 11/2009 | Kim et al. | |

* cited by examiner

*Primary Examiner* — Melvin Jones

(74) *Attorney, Agent, or Firm* — John W. Morrison; Kirk W. Goodwin; McKee, Vorhees & Sease PLC

(57) ABSTRACT

A refrigerator includes a refrigerator housing, a fresh food compartment disposed within the refrigerator housing, a door for providing access to the fresh food compartment, and an ice bin at the door, the ice bin having a window for viewing an ice level within the ice bin. An ice storage bin includes an ice storage bin body having an insulated front, a back, a bottom, opposite sides, and an open top, and a first window pane and a second window pane positioned at the front of the ice storage bin to allow for viewing the ice level within the ice storage bin. There may be an air gap between the first window pane and the second window pane.

21 Claims, 8 Drawing Sheets

ICE BIN STORAGE WINDOW

FIELD OF THE INVENTION

The present invention relates to refrigerators. More specifically, but not exclusively, the present invention relates to refrigerators with ice being stored in a location remote from the freezer such as in a fresh food compartment door.

BACKGROUND OF THE INVENTION

Refrigerators typically include ice storage bins. In one configuration of a refrigerator, the ice storage bin may be located at the door of the refrigerator. Either the ice is made at the door and stored in the ice storage bin or the ice is made elsewhere such as in a freezer compartment or ice maker compartment and the ice is conveyed to the ice storage bin at the door. In typical operation, a user can dispense ice using a water and ice dispenser located at the door. Alternatively, the user can open the door of the refrigerator to access the ice bin. However, the ice bin is typically in some form of insulated compartment, as the ice must be kept at a temperature lower than the temperature of the fresh food compartment. Thus, a user must perform additional steps in order to access the ice. These additional steps may include opening a compartment door or opening or removing the ice bin.

These extra steps may also be required when a user wants to check the level of ice in the ice storage bin. It may be difficult or inconvenient for a user to check the level of ice in the ice storage bin as a user may not be able to do so without opening a compartment in which the ice storage bin is located and then opening or removing the ice storage bin, or otherwise performing multiple steps to check the ice level. What is needed is a better way to check the level of ice in an ice storage bin.

SUMMARY

According to one aspect of the present invention a refrigerator is provided which includes a refrigerator housing, a fresh food compartment disposed within the refrigerator housing, a door for providing access to the fresh food compartment, and an ice bin at the door, the ice bin having a window for viewing an ice level within the ice bin. The ice bin may include an ice storage body having an insulated front, a back, a bottom, opposite sides, and an open top. There may be a first window pane and a second window pane positioned at the front of the ice storage bin to allow for viewing the ice level within the ice storage bin.

According to another aspect of the present invention, a refrigerator includes a refrigerator cabinet, a fresh food compartment disposed within the refrigerator cabinet, a freezer compartment disposed within the refrigerator cabinet, a fresh food compartment door for providing access to the fresh food compartment, a freezer compartment door for providing access to the freezer compartment, an ice bin operatively connected to the fresh food compartment door for storing ice, and a window for viewing an ice level within the ice bin. The window may be at least a portion of an insulated wall of the ice bin.

According to another aspect of the present invention, an ice storage bin is provided. The ice storage bin may include: an ice storage bin body having an insulated front, a back, a bottom, opposite sides, and an open top; a first window pane and a second window pane positioned at the front of the ice storage bin to allow for viewing the ice level within the ice storage bin; and an air gap between the first window pane and the second window pane.

DETAILED DESCRIPTION

Although the present invention is described with respect to various embodiments, the present invention is not to be limited to the specific embodiments described herein.

Figure 1:
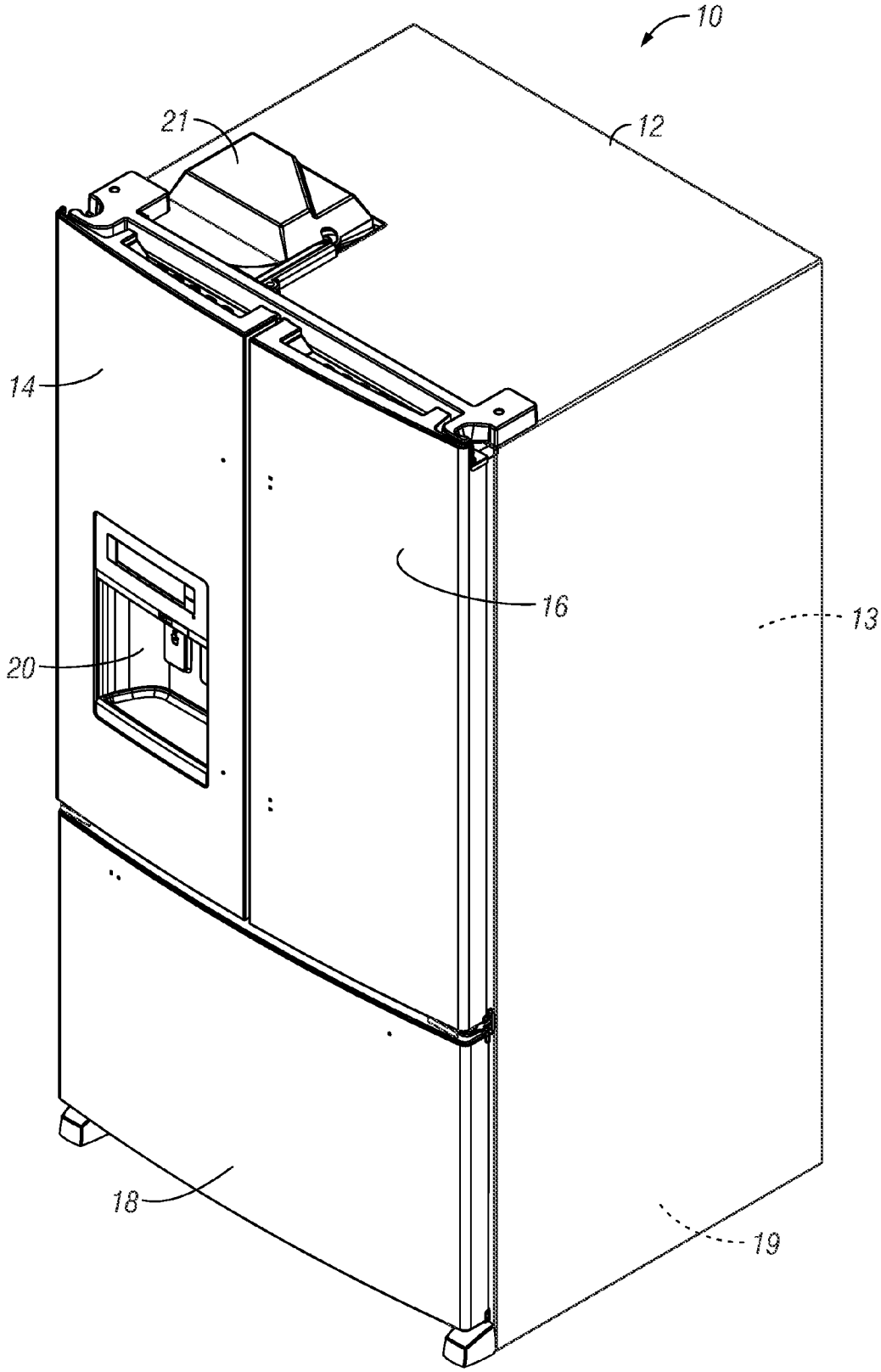
FIG. 1 is a perspective view illustrating one embodiment of a refrigerator with an ice bin with a window.

FIG. 1 is a perspective view illustrating one embodiment of a refrigerator with an ice bin with a window. The refrigerator 10 has a housing or cabinet 12. The cabinet 12 is an insulated cabinet. A left refrigerator door 14 and a right refrigerator door 16 provide access to a fresh food compartment 13. A freezer drawer 18 may be extended to provide access to items stored in a freezer compartment 19. A water and ice dispenser 20 is positioned on the left refrigerator door 14. An ice maker 21 is shown which is remote from the freezer compartment 19.

Figure 2A:
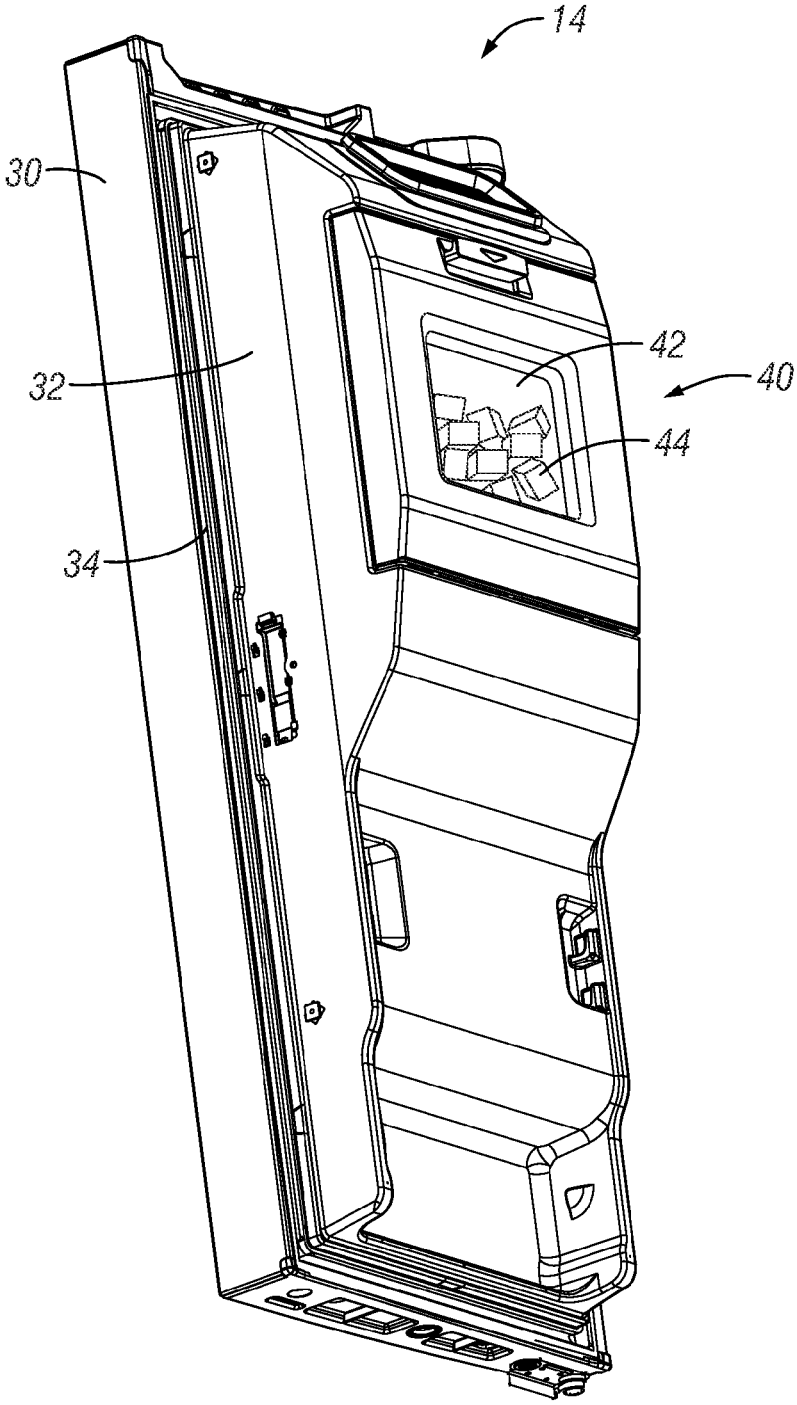
FIG. 2A is a perspective view showing an ice bin with a window on a fresh food compartment door of a refrigerator, with the ice bin in a closed position.

FIG. 2A is a perspective view showing an ice bin with a window on a fresh food compartment door of a refrigerator, with the ice bin in a closed position. In FIG. 2A, a door 14 has an outer case 30, an inner case 32, and a seal 34. An ice bin 40 is mounted on the door 14. The ice bin 40 is shown in a closed position. Because the ice bin 40 is mounted to a door 14 of the fresh food compartment, the ice bin 40 provides for insulating ice 44 within the ice bin. An ice bin window 42 allows a user to see the ice level of the ice 44 within the ice bin 40 without opening the ice bin 40.

Figure 2B:
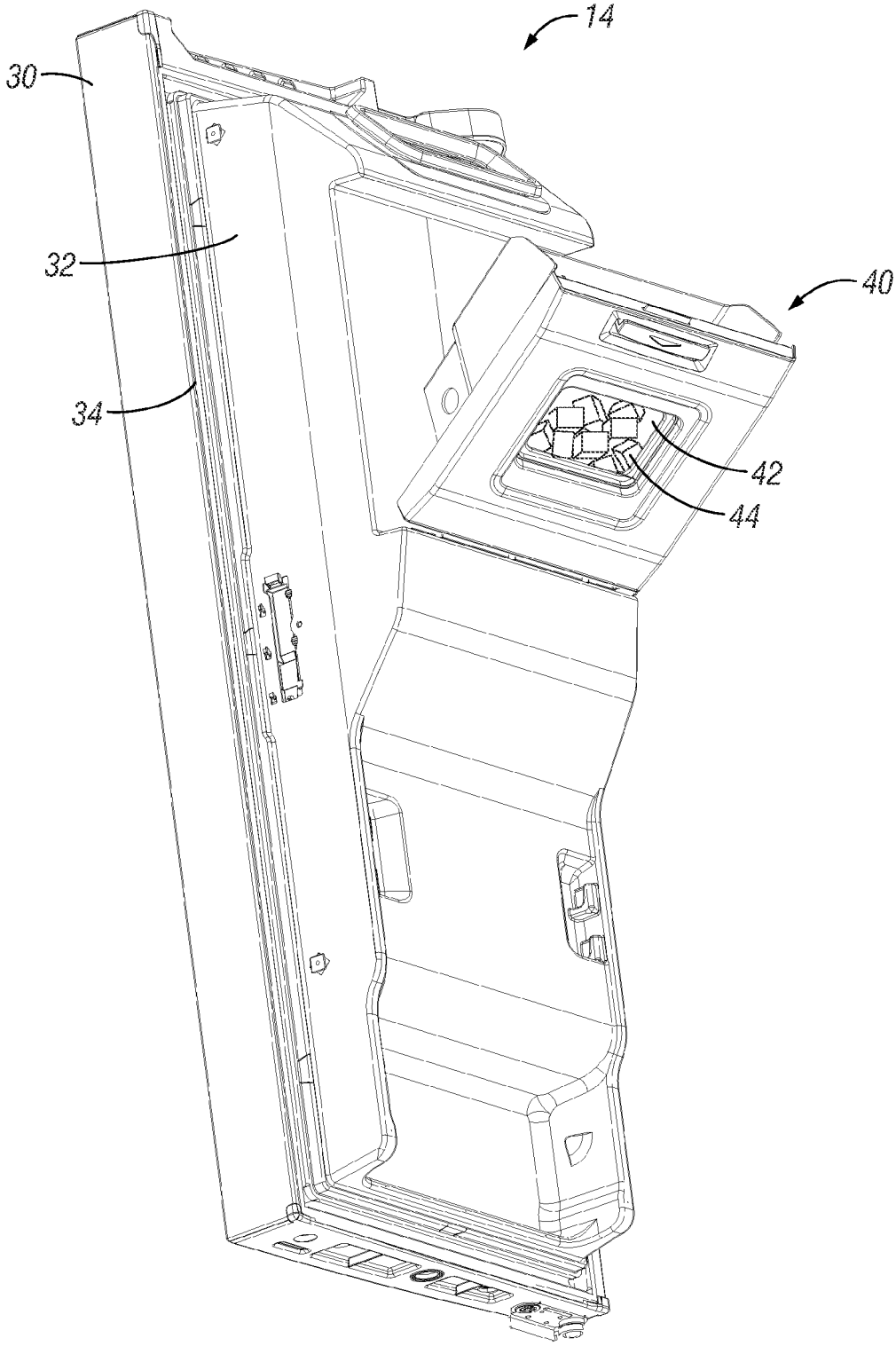
FIG. 2B is a perspective view illustrating the ice bin with a window on a fresh food compartment door of a refrigerator, with the ice bin tilted outwardly.
Figure 2C:
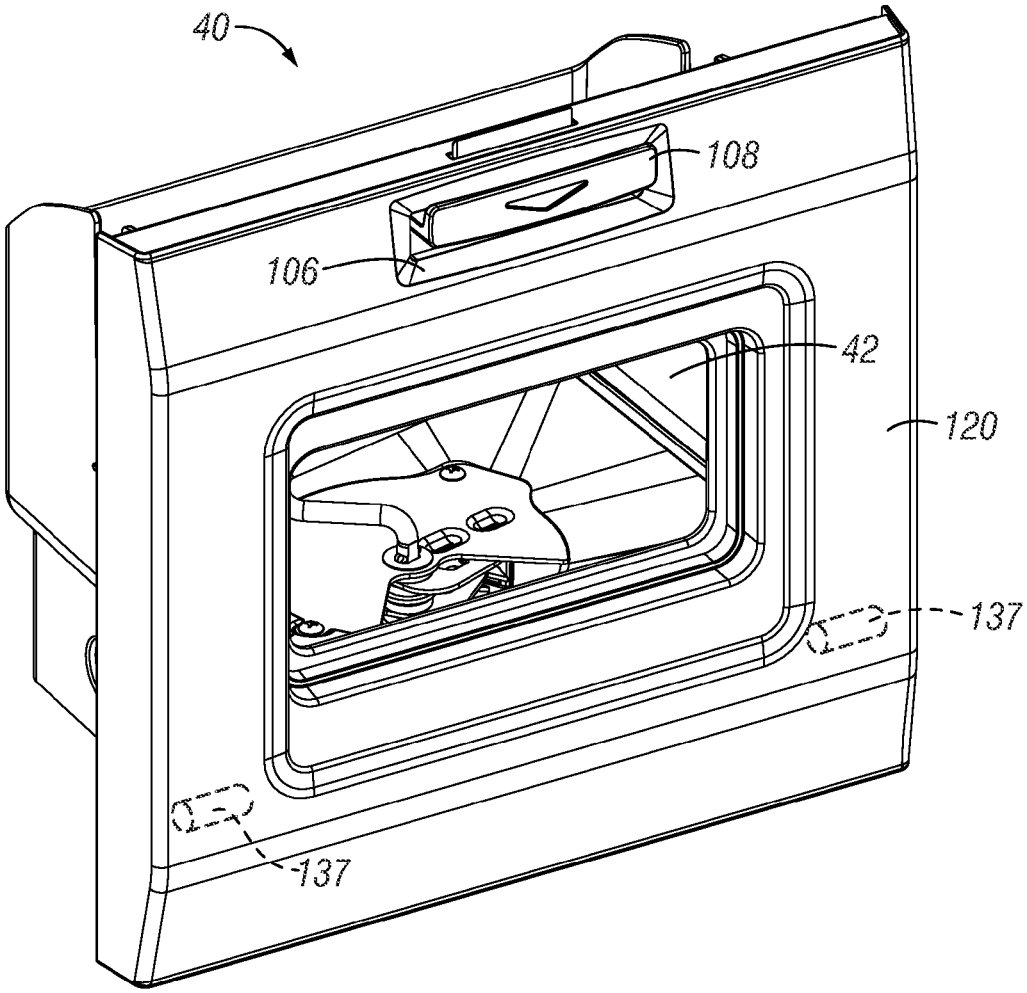
FIG. 2C is a perspective view illustrating a fresh food compartment door of a refrigerator with the ice bin removed.

FIG. 2B is a perspective view illustrating the ice bin 40 with a window 42 on a fresh food compartment door 14 of a refrigerator, with the ice bin 40 tilted outwardly to provide access to ice 44 within the ice bin 40. FIG. 2C is a perspective view illustrating a fresh food compartment door 14 of a refrigerator with the ice bin removed. The ice bin may be removably mounted to an ice bin plate on the door. One manner of doing so is to have protrusions or pins 137 on the ice bin 40 which fit guides in the mounting plate, thereby allowing the ice bin 40 to pivot open to provide access to ice within the ice bin 40 and also to allow the ice bin 40 to be easily and removed from the door 14 and replaced back onto the door 14.

Figure 3A:
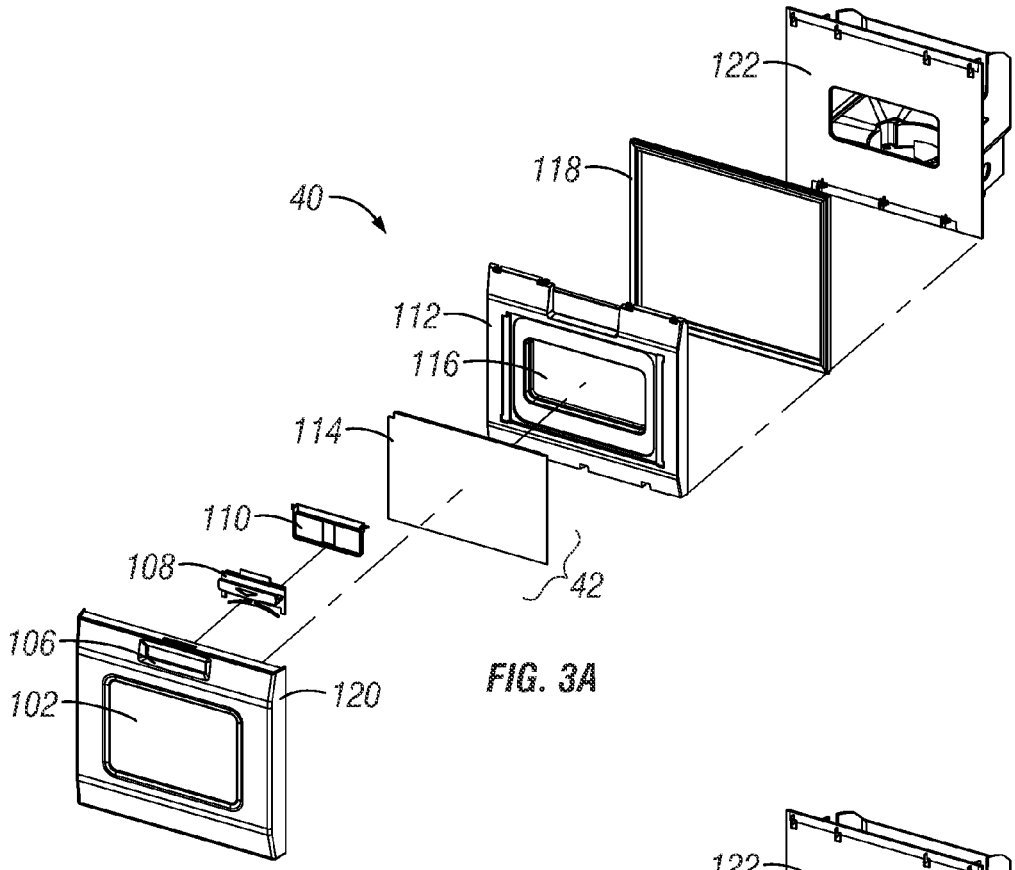
FIG. 3A is an exploded view of one embodiment of an ice bin door with a window.

FIG. 3 is an exploded view of one embodiment of an ice bin 40 with a window. The ice bin 40 has an insulated front 120 with a handle 106. A spring latch 108 and a cover latch 110 are also shown. A window 42 is shown. The window 42 is preferably formed of a glass or plastic material. The window 42 may be frosted. One advantage of the window 42 being frosted is that when clear, condensation on the window may affect the view of ice within the ice bin. When the window 42 is frosted, any effects of condensation are less noticeable. Of course, condensation can also be removed such as by having one or more heaters proximate the window 42.

Figure 3B:
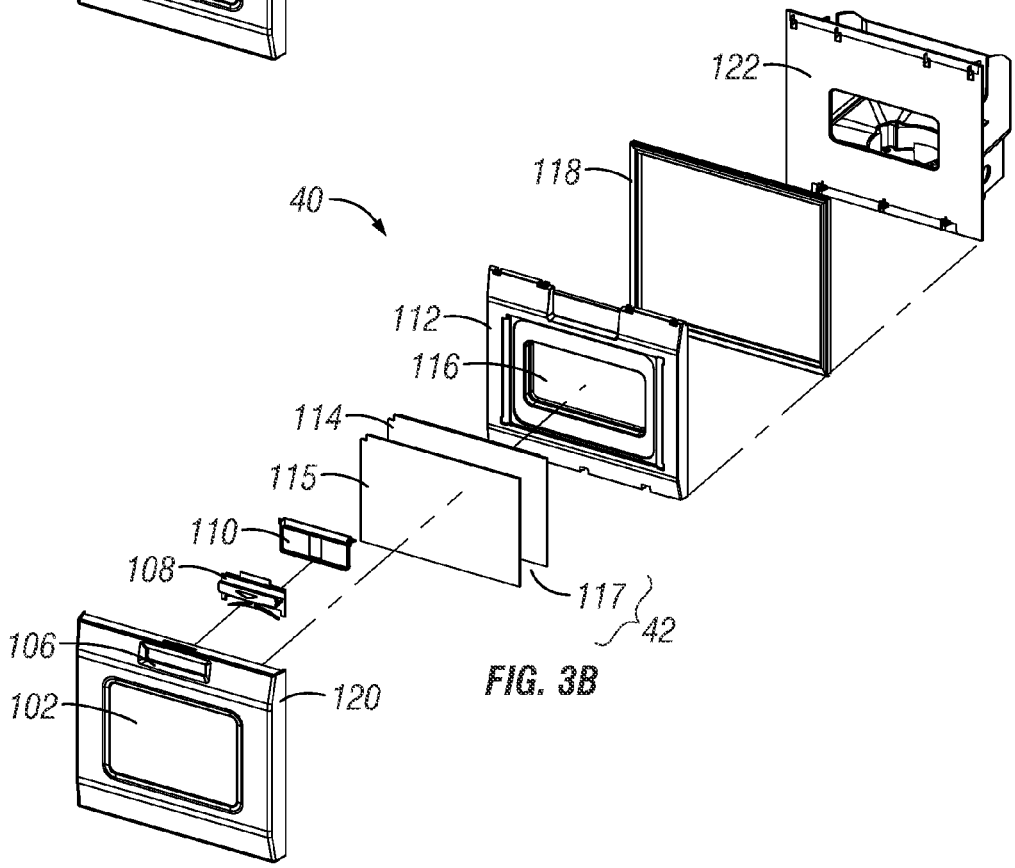
FIG. 3B is an exploded view of another embodiment of an ice bin door where a window is formed from multiple panes.

The window 42 may be made of a material sufficiently thick to provide for desired insulation. Thus, a single window pane 114 may be used. Alternatively, multiple panes may be used. Where multiple window panes are used, there may be an air gap between the panes to provide for additional insulation. FIG. 3B illustrates an embodiment where the window 42 includes both a first window pane 114, a second window pane 115, and an air gap 117 between the first window pane 114 and the second window pane 115. Of course, more than two window panes may be used.

The ice bin 40 may also include an insulating portion 112 which may be filled with expanded polystyrene (EPS) foam or other type of insulation. Note that there is an aperture 116 in the insulating portion 112, with which the window 42 is in alignment. A gasket 118 is shown to provide a seal between the insulating portion 112 and an ice container portion 122.

Figure 4:
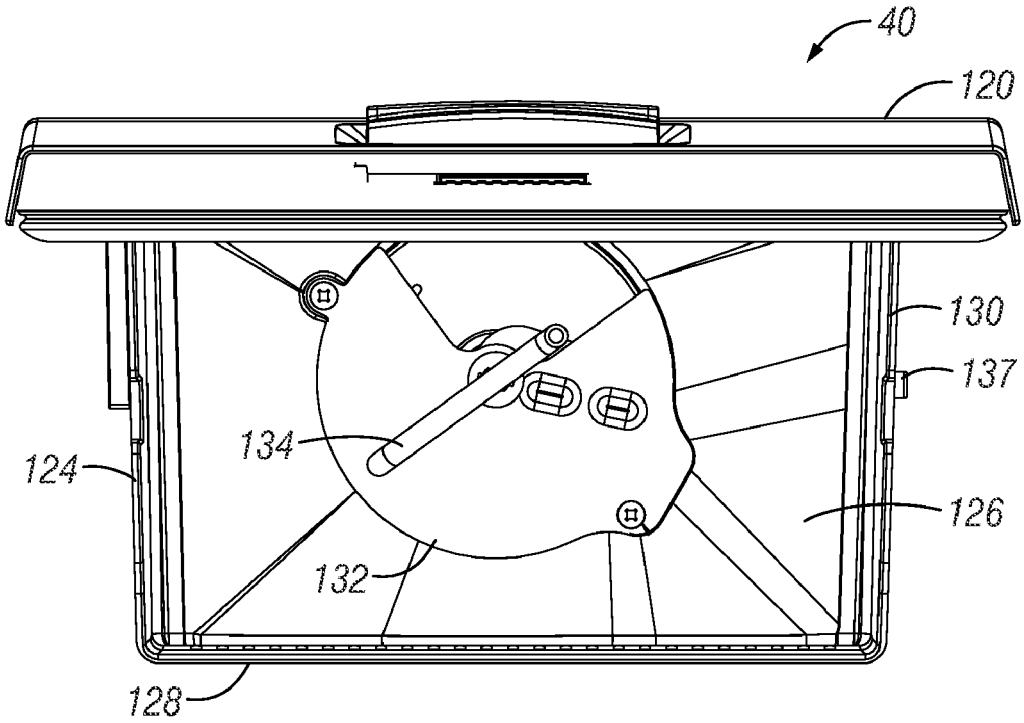
FIG. 4 is a top view of an ice bin.

FIG. 4 is a top view of an ice bin. The ice bin 40 includes an insulated front wall 120, a back wall 128, and opposite side walls 124, 130. An ice auger 134 and crushing assembly 132 are also shown.

Figure 5:
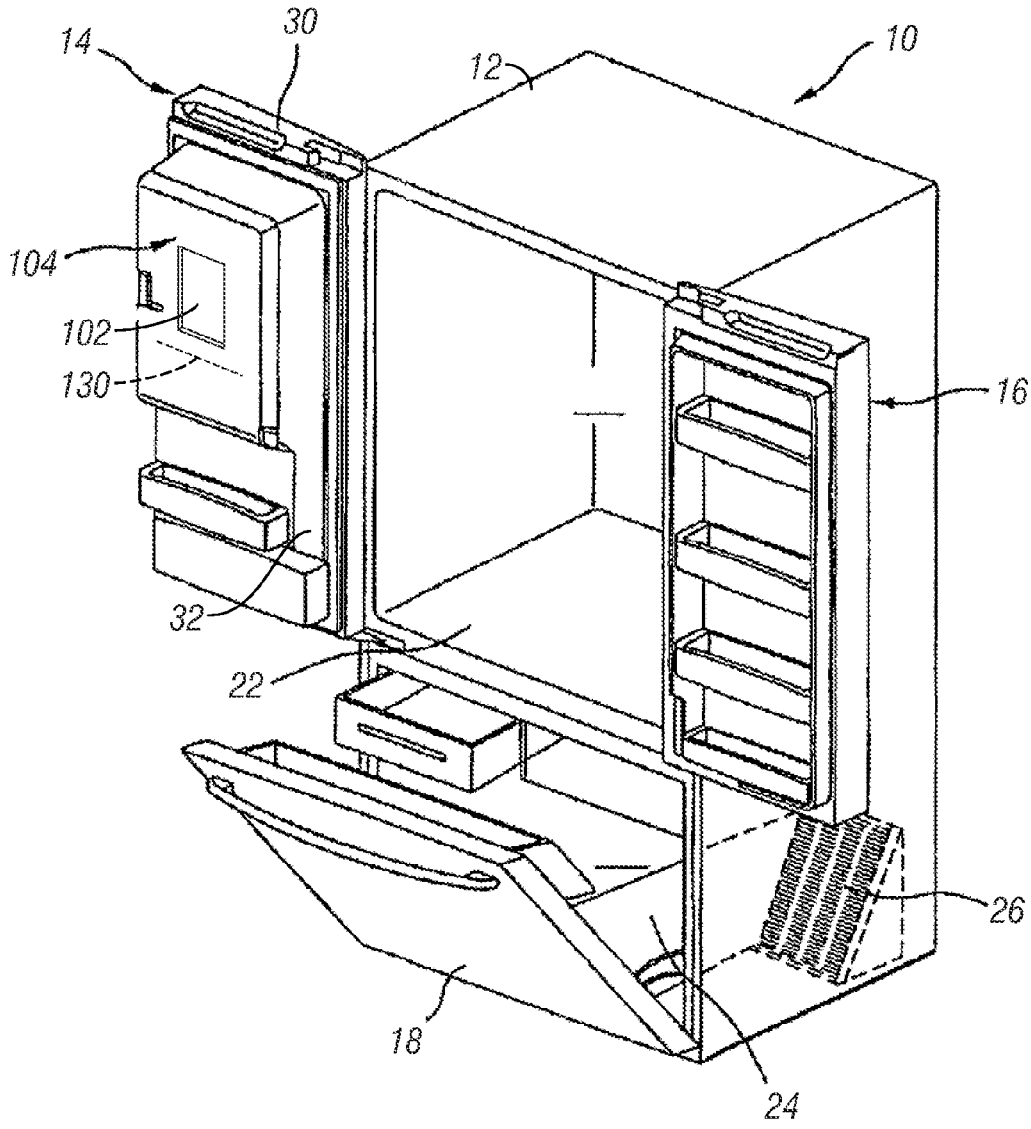
FIG. 5 is another embodiment of a refrigerator with a window for determining the level of ice in the ice bin.
Figure 6:
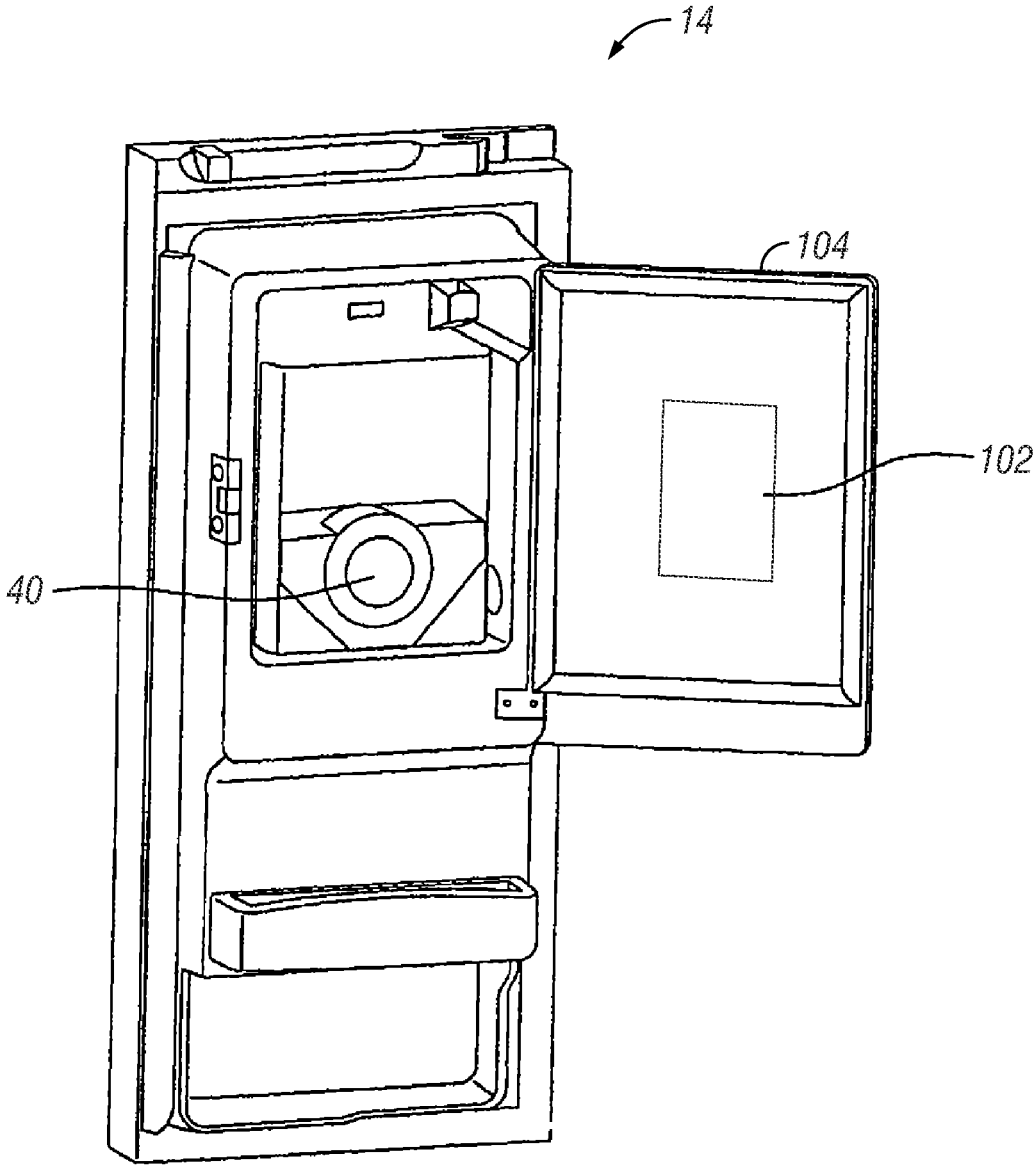
FIG. 6 illustrates the fresh food compartment door of the refrigerator of FIG. 5.

FIG. 5 is another embodiment of a refrigerator with a window for determining the level of ice in the ice bin. In the refrigerator 10 of FIG. 5, a door 104 is opened to provide access to ice within an ice container. The window 102 allows a user to see the level of ice within the ice container without opening the door 104. The window 102 may be frosted. One or more heaters such as a heater element 130 may be used to heat the window 102. The heater element 130 may be an electric heater element 130 as shown. FIG. 6 illustrates the fresh food compartment door of the refrigerator of FIG. 5 when the door 104 is in an open position.

A refrigerator with a window to allow for determination of the level of ice within an ice bin has been described. The present invention contemplates numerous variations, options, and alternatives, including variations in the structure or configuration of the refrigerator, variations in the type of material used for the window, the number of panes used for the window, the location of the window, whether the window is frosted or not, whether a heater is used to heat the window or not, and other variations. The present invention is not to be limited to the specific embodiments described herein or combinations of the specific embodiments described.

What is claimed is:

1. A refrigerator, comprising:
- a refrigerator housing;
- a fresh food compartment disposed within the refrigerator housing;
- a door for providing access to the fresh food compartment;
- an ice bin at the door, the ice bin having a window for viewing an ice level within the ice bin;
- wherein the ice bin comprises an ice storage body having an insulated front, a back, a bottom, opposite sides, and an open top.

2. The refrigerator of claim 1 further comprising a first window pane and a second window pane positioned at the front of the ice storage bin to allow for viewing the ice level within the ice storage bin.

3. The refrigerator of claim 1 wherein the window comprises a first window pane and a second window pane to assist in insulating the ice bin from the fresh food compartment.

4. The refrigerator of claim 3 further comprising an air gap between the first window pane and the second window pane.

5. The refrigerator of claim 1 wherein the window being at least a portion of an insulated wall of the ice bin.

6. The refrigerator of claim 1 wherein the ice bin being tiltable.

7. The refrigerator of claim 6 wherein the ice bin being removable.

8. The refrigerator of claim 1 wherein the window comprises a frosted material.

9. The refrigerator of claim 1 further comprising a heater proximate the window.

10. A refrigerator, comprising:
- a refrigerator cabinet;
- a fresh food compartment disposed within the refrigerator cabinet;
- a freezer compartment disposed within the refrigerator cabinet;
- a fresh food compartment door for providing access to the fresh food compartment;
- a freezer compartment door for providing access to the freezer compartment;
- an ice bin operatively connected to the fresh food compartment door for storing ice;
- a window for viewing an ice level within the ice bin;
- wherein the window being at least a portion of an insulated wall of the ice bin.

11. The refrigerator of claim 10 wherein the ice bin comprises an ice storage body having an insulated front, a back, a bottom, opposite sides, and an open top.

12. The refrigerator of claim 11 wherein the window being within the insulated front of the ice storage body of the ice bin.

13. The refrigerator of claim 10 wherein the window being a window in a wall of an ice compartment operatively connected to the fresh food compartment door, the ice bin disposed within the ice compartment.

14. The refrigerator of claim 10 wherein the window being formed of a frosted material.

15. The refrigerator of claim 10 wherein the window comprises a first window pane and a second window pane positioned at a front of the ice bin.

16. The refrigerator of claim 15 further comprising an air gap between the first window pane and the second window pane.

17. The refrigerator of claim 10 wherein the ice bin being tillable.

18. The refrigerator of claim 10 wherein the ice bin being removable.

19. An ice storage bin, comprising:
- an ice storage bin body having an insulated front, a back, a bottom, opposite sides, and an open top;
- a first window pane and a second window pane positioned at the front of the ice storage bin to allow for viewing an ice level within the ice storage bin; and
- an air gap between the first window pane and the second window pane.

20. The ice storage bin of claim 19 wherein at least one of the first window pane and the second window pane being frosted.

21. The ice storage bin of claim 19 further comprising protrusions extending from the ice storage bin body for operatively connecting the ice storage bin body to a door of a refrigerator.

* * * * *

UNITED STATES PATENT AND TRADEMARK OFFICE

CERTIFICATE OF CORRECTION

PATENT NO. : 8,033,133 B2
APPLICATION NO. : 12/277662
DATED : October 11, 2011
INVENTOR(S) : Laura E. Flores et al.

It is certified that error appears in the above-identified patent and that said Letters Patent is hereby corrected as shown below:

Col. 4, lines 46 - 47, Claim 17: "The refrigerator of claim 10 wherein the ice bin being tillable." should be Claim 17: --The refrigerator of claim 10 wherein the ice bin being tiltable.--

Signed and Sealed this
Fourteenth Day of August, 2012

David J. Kappos

David J. Kappos
*Director of the United States Patent and Trademark Office*